US010563648B2

(12) United States Patent
Conrad

(10) Patent No.: US 10,563,648 B2
(45) Date of Patent: Feb. 18, 2020

(54) MEMBRANE VACUUM PUMP

(71) Applicant: Pfeiffer Vacuum GmbH, Asslar (DE)

(72) Inventor: Armin Conrad, Herborn (DE)

(73) Assignee: Pfeiffer Vacuum GmbH, Asslar (DE)

( * ) Notice: Subject to any disclaimer, the term of this patent is extended or adjusted under 35 U.S.C. 154(b) by 232 days.

(21) Appl. No.: 15/245,347

(22) Filed: Aug. 24, 2016

(65) Prior Publication Data

US 2017/0058883 A1 Mar. 2, 2017

(30) Foreign Application Priority Data

Aug. 24, 2015 (EP) ..... 15182144

(51) Int. Cl.

| | |
|---|---|
| ***F04B 45/047*** | (2006.01) |
| ***F04B 35/04*** | (2006.01) |
| ***F04B 37/16*** | (2006.01) |
| ***F04B 43/04*** | (2006.01) |
| ***F04B 37/14*** | (2006.01) |
| ***F04B 43/00*** | (2006.01) |
| ***F04B 43/02*** | (2006.01) |
| ***F04B 43/14*** | (2006.01) |
| ***F04B 41/06*** | (2006.01) |
| ***F04B 45/04*** | (2006.01) |
| ***F04B 49/06*** | (2006.01) |

(Continued)

(52) U.S. Cl.

CPC ..... *F04B 45/047* (2013.01); *F04B 35/045* (2013.01); *F04B 37/14* (2013.01); *F04B 37/16* (2013.01); *F04B 41/06* (2013.01); *F04B 43/0054* (2013.01); *F04B 43/02* (2013.01); *F04B 43/023* (2013.01); *F04B 43/04* (2013.01); *F04B 43/14* (2013.01); *F04B 45/041* (2013.01); *F04B 49/06* (2013.01); *F04B 49/22* (2013.01); *F04B 53/1075* (2013.01)

(58) Field of Classification Search

CPC .... F04B 43/023; F04B 43/025; F04B 43/046; A61M 1/1055; A61M 1/1058

See application file for complete search history.

(56) References Cited

U.S. PATENT DOCUMENTS

| | | | | |
|---|---|---|---|---|
| 2,659,310 A | | 11/1953 | Ryba | |
| 4,498,850 A | * | 2/1985 | Perlov | F04B 35/00 417/322 |
| 4,599,083 A | | 7/1986 | Perlov | |

(Continued)

FOREIGN PATENT DOCUMENTS

| | | |
|---|---|---|
| DE | 863701 | 1/1953 |
| GB | 7100368 | 12/1953 |
| JP | 0443875 | 2/1992 |

*Primary Examiner* — Patrick Hamo

(74) *Attorney, Agent, or Firm* — Abelman, Frayne & Schwab

(57) ABSTRACT

A membrane vacuum pump has at least one working space which is bounded by a membrane deformable to change the size of the working space and by a wall in which at least one inlet and at least one outlet are formed for a medium which is sucked into the working space which increases in size in so doing in a suction phase and is expelled via the outlet from the working space which decreases in size in so doing in a compression phase. The membrane vacuum pump furthermore has a controllable actuator unit for deforming the membrane by a contactless action on the membrane by means of electrical and/or magnetic fields.

27 Claims, 2 Drawing Sheets

Figure 1:
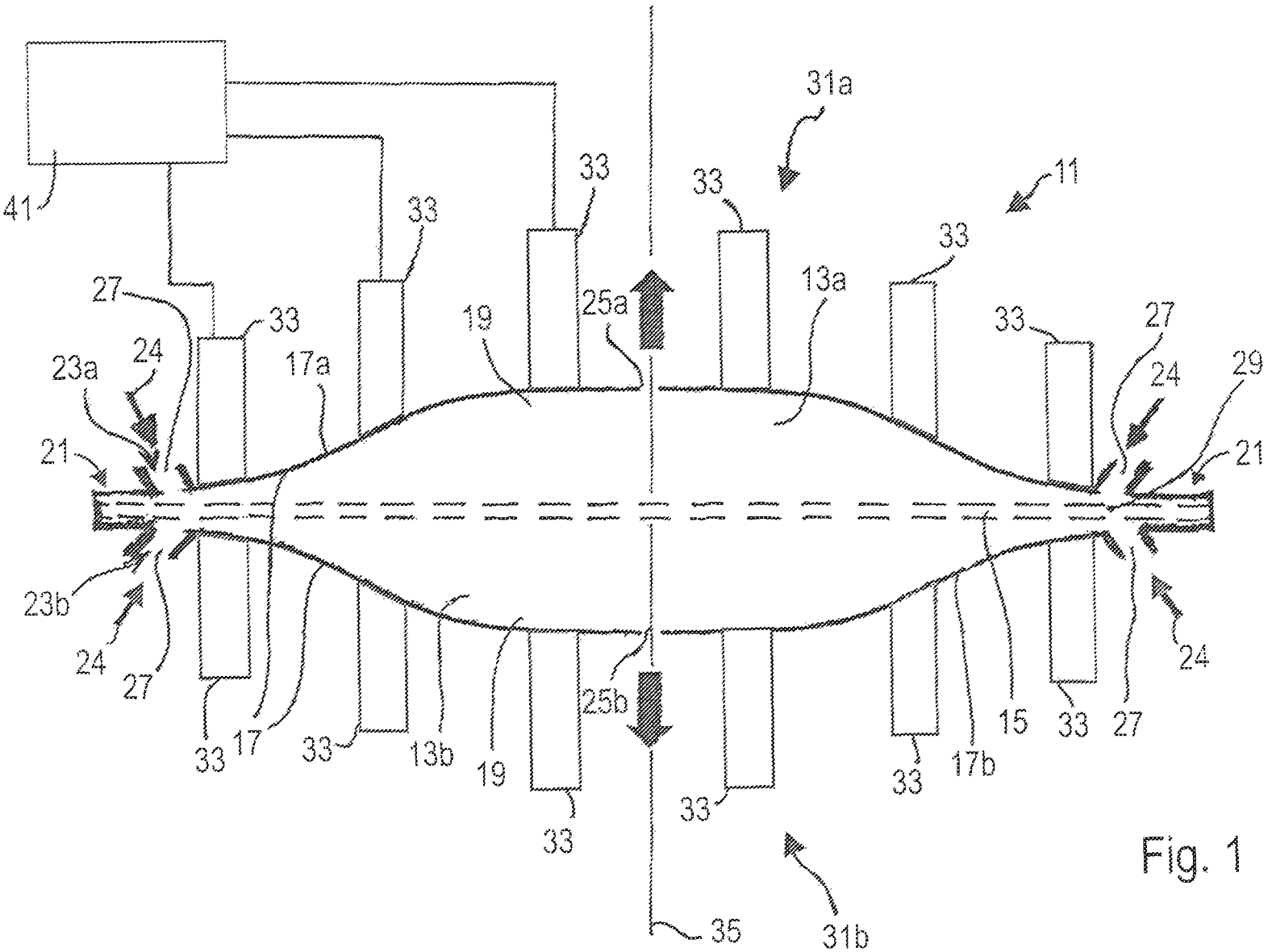

(51) Int. Cl.
*F04B 49/22* (2006.01)
*F04B 53/10* (2006.01)

(56) References Cited

U.S. PATENT DOCUMENTS 8,678,787 B2 * 3/2014 Hirata ..... F04B 43/046
417/395
2014/0017097 A1 1/2014 Conrad

* cited by examiner

MEMBRANE VACUUM PUMP

The present invention relates to a membrane vacuum pump.

With known membrane vacuum pumps, a membrane which bounds a suction space or working space is typically deflected mechanically or hydraulically in order thereby to increase the size of the suction space in a suction phase and to decrease it in a compression phase. To convey a medium by means of a membrane vacuum pump, valves are necessary at an inlet and at an outlet of the suction space, wherein one valve is closed at the outlet during the suction phase and one valve is closed at the inlet during the compression phase.

The components which are required for the mechanical or hydraulic deflection of the membrane represent a disadvantage of a conventional membrane vacuum pump. These components require a certain construction space and, in addition, wear occurs either at the components themselves or at the membrane. In addition, conventional membrane vacuum pumps have an unused space, that is a so-called "dead volume", at a reverse point of the membrane in the compression phase whose gas content is not expelled via the outlet.

A membrane vacuum pump is proposed in EP 2 685 104 A1 in which a membrane composed of a magnetorheological or of an electrorheological material is arranged in a flow passage between oppositely disposed actuators which are arranged at both sides of the flow passage. The membrane is deflected in the flow passage by a suitable control of the actuators such that a fluid volume is encapsulated in the flow passage and is subsequently transported along the flow passage from an inlet to an outlet of the membrane vacuum pump. It is a disadvantage with this membrane vacuum pump that the actuators have to be arranged at both sides of the flow passage to encapsulate the fluid volume and that a complex control of the actuators and an intense deformation of the membrane at a plurality of points and in different directions is necessary for the transport of the fluid volume.

It is an object of the present invention to provide a membrane vacuum pump which, on the one hand, has a compact and simple design and which, on the other hand, overcomes the disadvantages of conventional membrane vacuum pumps, in particular with respect to wear and dead volume.

This object is satisfied by a membrane vacuum pump having the features of claim 1.

The membrane vacuum pump in accordance with the invention has at least one working space which is bounded by a membrane which is deformable to vary the size of the working space and has a controllable actuator unit which is provided to deform the membrane by a contactless action on the membrane by means of electrical and/or magnetic fields. At least one inlet and at least one outlet for a medium are formed in the wall which bounds the working space. The medium is sucked into the working space via the inlet in a suction phase, with the working space increasing in size in so doing, and is expelled from the working space via the outlet in a compression phase, with the working space decreasing in size in so doing.

The suction phase and the compression phase alternate periodically during a pumping process in the membrane vacuum pump. In this respect, the duration of the suction phase and of the compression phase can each be set by the action on the membrane by means of the electrical and/or magnetic fields. The pumping frequency of the membrane vacuum pump can be controlled in this manner.

Since the action on the membrane for its deformation takes place in a contactless manner, the membrane is the only part of the membrane vacuum pump which has to move. Very little wear therefore occurs during the pumping process of the membrane vacuum pump and the membrane vacuum pump has a correspondingly long service life.

Since the membrane vacuum pump ultimately only comprises the wall and the membrane which form the working space, it has a compact and simple design. The membrane vacuum pump can thereby also be used as a roughing pump in those cases, for example for a turbomolecular pump, in which there is little space available for a roughing pump. The membrane vacuum pump in accordance with the invention furthermore has low manufacturing costs due to the small total number of parts required.

The membrane can be designed with a smooth and constant thickness. It is alternatively possible to provide the membrane with a profiling on both sides. The thickness of the membrane can furthermore vary, with in particular the thickness profile of the membrane being able to be adapted to the shape of the wall, in particular to the shape of a recess formed in the wall.

Advantageous embodiments of the invention are also set forth in the dependent claims, in the description and in the Figures.

In accordance with an embodiment, the working space has an axis along which the membrane is deformable. The axis is furthermore surrounded by an annular sealing region between the membrane and the wall. The working space is in this respect preferably formed rotationally symmetrically with respect to the axis.

The working space of the membrane vacuum pump is closed and sealed by the annular sealing region during the pumping process. Since the sealing region surrounds the axis in an annular form, the membrane is mainly deformed within this ring. An efficient increase and decrease in size of the working space on the deformation of the membrane thereby takes place, for example, starting from the sealing region, inwardly in the direction of the axis.

With a rotationally symmetrical design of the working space with respect to the axis, the sealing region is likewise rotationally symmetrical with respect thereto and the working space can be manufactured in a simple manner. A uniform concentric deformation of the membrane furthermore takes place in this case in which at most small strains occur in the membrane.

The inlet of the vacuum pump can comprise one or more openings which are formed in the wall in the region of an annular sealing region between the membrane and the wall. Since the deformation of the membrane takes place within the annular sealing region, the inlet is thus located in a marginal region of the wall or of the membrane in which the membrane has the maximum extent. If the inlet comprises a plurality of openings, the volume of the medium which can be received by the vacuum pump in the suction phase can be maximized by the arrangement of the openings in the annular sealing region.

The inlet is furthermore preferably closable by means of the membrane. A valve at the inlet of the vacuum pump, which is necessary with conventional membrane vacuum pumps, can thereby be dispensed with.

In accordance with a further advantageous embodiment, the working space of the vacuum pump comprises a recess formed in the wall. In this respect, the membrane is deformable by means of the actuator unit into the recess in the compression phase and out of the recess in the suction phase.

The recess is preferably rotationally symmetrical with respect to an axis of the working space.

The maximum size of the working space is thus at least partly predefined by the shape of the recess. The working space furthermore also has a predefined size when the membrane is in a non-deformed state. The membrane can furthermore advantageously be deformed into the recess up to contact at the wall in the compression phase. The above-described dead volume, which is disadvantageous in conventional membrane vacuum pumps, is thereby avoided. In addition, the recess can be designed such that only a slight deformation of the membrane is necessary during the pumping process of the vacuum pump. The service life of the membrane and of the vacuum pump is thereby in turn further extended overall due to the reduced wear.

In accordance with a further embodiment, the wall defines a curve which is continuously differentiable in every cross-section including an axis of the working space. The deformation of the membrane can take place along this curve. Excessive or even kinking deformations of the membrane can be avoided by this design of the wall. The membrane can nestle at the wall so that the mechanical strain on the membrane is reduced to a minimum and its service life is thus further extended.

The actuator unit is preferably controllable such that the membrane can be deformed in a different manner over time and/or in location. The control of the actuator unit in this respect advantageously takes place by a control device which controls the actuator unit such that the time development of the deformation of the membrane and/or the spatial design of the deformation are fixed. Not only a control of the pumping frequency of the vacuum pump thus takes place, but the degree and the shape can furthermore also be controlled on the change of the size of the working space.

The membrane is furthermore preferably inwardly deformable from an outer marginal region in the direction of an axis of the working space. A uniform deformation of the membrane from the outside to the inside thereby takes place and small strains therefore occur within the membrane.

The actuator preferably comprises a plurality of actuators which can be acted on electrically and which can, for example, be electromagnets or electrodes. The membrane accordingly preferably comprises or consists of a material which is magnetic and/or magnetizable or which is electrorheological or magnetorheological or dielectric. The selection of the material of the membrane thus takes place in a manner matching the type of the actuators.

The actuators which can be electrically acted on can in this respect be controlled by relatively simple, inexpensive electronics which are integrated in the control device. The control of the actuators which can be acted on electrically can furthermore take place in accordance with the properties of the membrane to reach the required pumping frequency or the required suction capacity of the vacuum pump.

The actuator unit preferably comprises a plurality of actuators arranged distributed at the wall outside the working space. The individual actuators can be individually controlled and can be serviced or replaced individually by such a modular design of the actuator unit. In addition, the membrane can be sectionally deformed by an individual control of the actuators arranged distributed at the wall. The actuators are in this respect in particular arranged concentrically about an axis of the working space. This in turn simplifies the production of the pump and in addition a uniform deformation of the membrane is possible if it has a correspondingly disk-like design.

In accordance with a further advantageous embodiment, the membrane separates two working spaces respectively bounded by a wall from one another. In this case, a single membrane effects a change of the size of two working spaces simultaneously by a corresponding deformation. If a working space is increased in size in the suction phase by the deformation of the membrane, the second working space is accordingly simultaneously reduced in size by the deformation of the membrane in the compression phase. Two pump stages can thereby be implemented simultaneously with a single membrane.

If two pump stages are to be formed in series, the outlet of the one working space is connected to the inlet of the other working space. A vacuum pump having a higher compression is thereby produced. For a parallel connection of two pump stages, in contrast, the inlets of both working spaces are connected in parallel, i.e. are connected to the same recipient or to the outlet of a further pump. An increased suction capacity of the entire vacuum pump having two pump stages thereby results.

In general, as many vacuum pumps in accordance with the invention as desired can be combined with one another. For example, modules of a plurality of pump stages connected in parallel can also be combined either with the modules of the same type or with modules which comprise a plurality of pump stages connected in series to form a total pump unit.

The actuator unit is preferably controllable such that the respective outlet of the one working space remains closed by the membrane until the inlet of the other working space is closed by means of the membrane. In the case of two pump stages connected in series, a valve at the outlet of the first pump stage can thereby be dispensed with since the membrane takes over the function of such a valve by the time-controlled closing of the outlet of the one working space and of the inlet of the other working space.

Finally, the invention relates to a system having at least two cooperating vacuum pumps in accordance with the invention. In this respect, the vacuum pumps are preferably connected in series or in parallel, wherein—as already mentioned above—both parallel connections and serial connections can also be provided within a total pump. A plurality of modules in which a respective plurality of pumps are connected in series can thus e.g. be connected in parallel.

In general, a module system can be provided, in particular due to the compactness, the simple design and the small manufacturing costs of the pump in accordance with the invention, which allows a more or less complex pump system to be put together from individual pumps of the type in accordance with the invention, which can generally be of any desired number, in which pump system the individual pumps or modules or groups of pumps are connected to one another and can be controlled in accordance with the demands of the respective application.

Figure 2A:
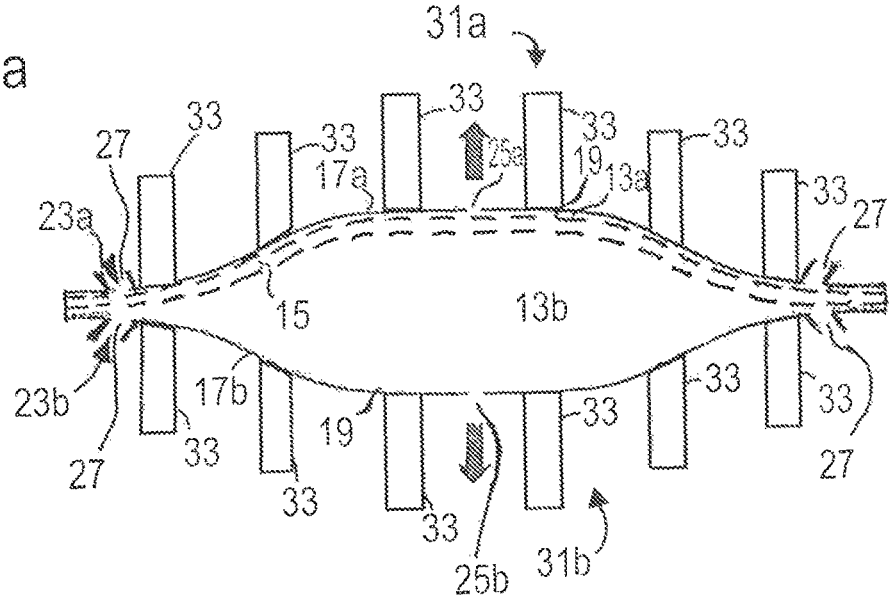
Figure 2B:
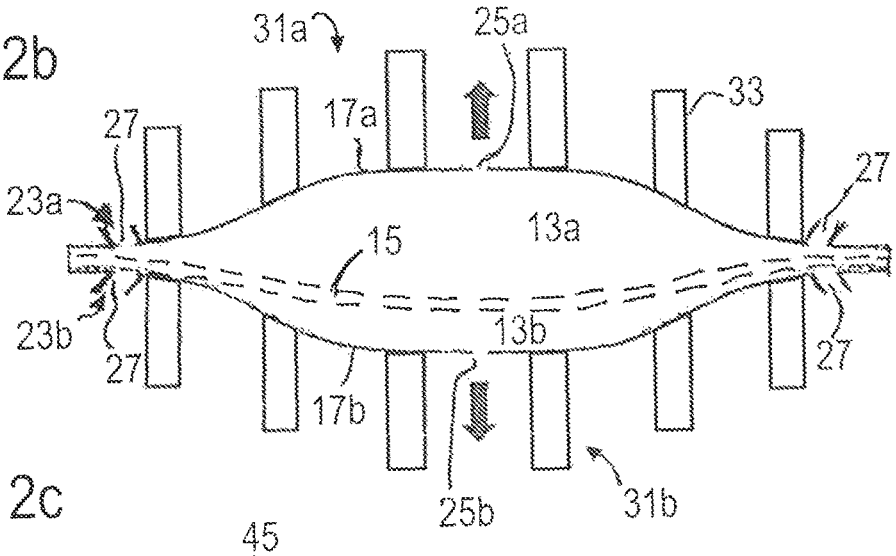
Figure 2C:
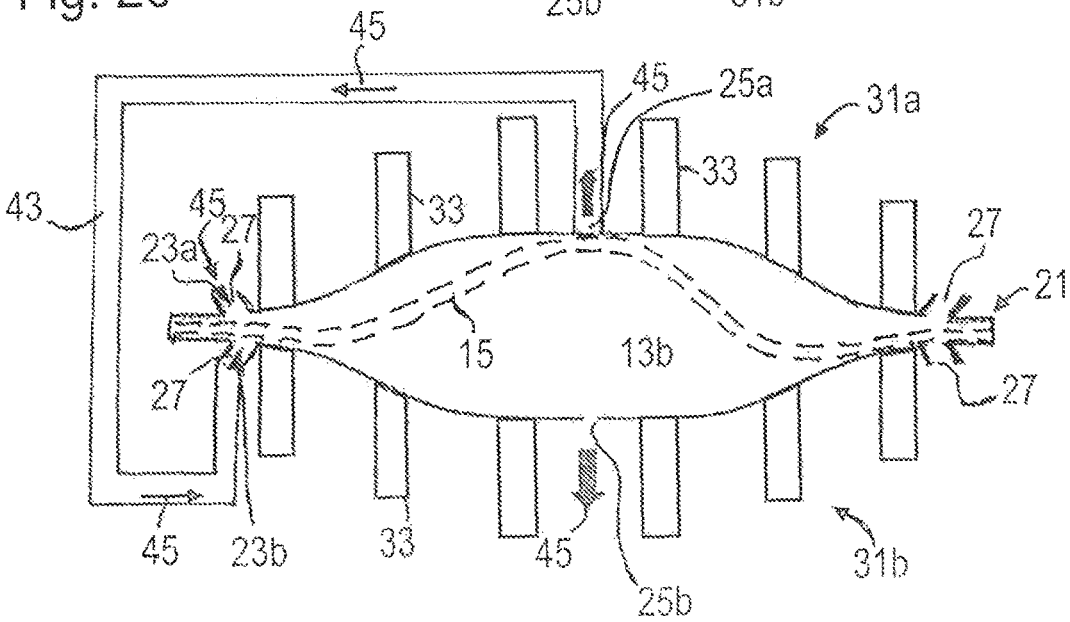

The invention will be explained purely by way of example with reference to the enclosed Figures which represent an embodiment of a vacuum pump in accordance with the invention. There are shown:

FIG. 1 a schematic sectional view of a membrane vacuum pump in accordance with the invention; and FIGS. 2*a* to 2*c* schematic sectional views of the membrane vacuum pump in accordance with the invention which illustrate its operation.

FIG. 1 shows an embodiment of a membrane vacuum pump 11 in accordance with the invention in a schematic sectional view. The vacuum pump 11 has a working space which is divided by a membrane 15 into an upper working space 13*a* and a lower working space 13*b*. The working space is furthermore bounded by a wall which is composed of an upper wall half 17*a* and a lower wall half 17*b*.

The upper and lower wall halves 17*a*, 17*b* each have a recess 19 with respect to the membrane 15 which is located in a position of rest in the illustration. In a marginal region 21, the wall, i.e. the respective upper wall half 17*a* and the lower wall half 17*b*, comprises inlets 23*a*, 23*b*, whereas a respective outlet 25*a*, 25*b* is arranged at the center of the recess 19. A gaseous medium which is to be conveyed by means of the pump 11 moves via the inlets 23*a*, 23*b* into the working space 13, as is indicated by the arrows 24. The medium is expelled from the outlets 25*a*, 25*b* by the pumping process and ultimately moves via lines into a region which is at atmospheric pressure, for example.

The inlets 23*a*, 25*b* furthermore comprise a plurality of openings 27 which are located in a sealing region 29 in which the openings 27 are closed by means of the membrane 15 on the expulsion of the medium through the outlets 25*a*, 25*b*. The openings 27 can e.g. be provided in the form of circular or slit-shaped apertures.

The vacuum pump 11 furthermore has an actuator unit which consists of an upper actuator unit 31*a* and a lower actuator unit 31*b* which are controllable separately from one another. The actuator units each have a plurality of electromagnets 33 as actuators which are arranged outside the working space 13 and outside the respective wall 17*a*, 17*b* and are distributed over them.

The membrane 15 comprises a magnetorheological elastomer material. If one or more of the electromagnets 33 are activated, the membrane 15 is pulled in the direction of the activated electromagnet or electromagnets 33 due to the magnetorheological elastomer material, i.e. it is deformed into or out of one of the respective recesses 19 of the respective wall 17*a*, 17*b*.

The total arrangement of the vacuum pump 11 is rotationally symmetrical with respect to an axis 35. The electromagnets 33 are thus either respective annular magnets at the individual radial positions or a plurality of respective discrete, individual magnets are provided at the individual radial positions and are uniformly arranged in an annular manner in the peripheral direction. The individual openings 27 of the inlets 23*a*, 23*b* are each uniformly distributed over the annular sealing region 29. The radial positions of the electromagnets 33 are uniformly distributed over the respective wall 17*a*, 17*b*.

The electromagnets 33 of the actuator units 31*a*, 31*b* are controlled by a control device 41. Only connections to the electromagnets 33 of the upper actuator unit 31*a* are shown in FIG. 1 for reasons of simplicity. The electromagnets 33 of the lower actuator unit 31*b* are likewise connected to the control device 41. All the electromagnets 33 can be controlled independently of one another so that the membrane 15 can be specifically differently deformable in different part regions.

The function of the membrane vacuum pump 11 in accordance with the invention is illustrated in FIGS. 2*a* to 2*c*.

The electromagnets 33 of the upper actuator unit 31*a* are activated in FIG. 2*a*, while the electromagnets 33 of the lower actuator unit 31*b* are deactivated. The membrane 15 therefore contacts the upper wall half 17*a*, i.e. in its recess 19, due to the magnetic interaction between its magnetorheological material and the electromagnets 33 of the upper actuator unit 31*a*.

The upper working space 13*a* is therefore at the end of the compression phase in FIG. 2*a* and has a size of practically zero. The lower working space 13*b*, in contrast, is at the end of the suction phase in which the openings 27 of the inlet 23*b* are open. A check valve, not shown, at the outlet 25*b* of the lower working space 13*b* prevents a backflow over the outlet 25*b* into the lower working space 13*b* in its suction phase.

The electromagnets 33 of the upper working space 31*a* are subsequently deactivated, while the electromagnets 33 of the lower actuator unit 31*b* are activated. The membrane 15 is thereby released from the upper wall half 17*a* and moves in the direction of the lower wall half 17*b*. In this respect the actuator units 31*a*, 31*b* are controlled such that the membrane 15 reaches the lower wall half 17*b* in its sealing region 29 at an early time and thus closes the openings 27 of the inlet 23*b* in the lower wall half 17*b* to initiate the compression phase of the lower working space 13*b*.

As soon as the openings 27 of the inlet 23*b* in the lower wall half 17*b* are completely closed, the compression phase starts in the lower working space 13*b*. In FIG. 2*b*, the lower working space 13*b* is in the compression phase, while the upper working space 13*a* is in the suction phase since the openings 27 of the inlet 23*a* in the upper wall half 17*a* are open.

The medium to be conveyed is expelled via the outlet 25*b* of the lower working space 13*b* in its compression phase. At the same time, a check valve, not shown, at the outlet 25*a* of the upper working space 13*a* in turn prevents a backflow into said working space during its suction phase.

The membrane 15 lies at the lower wall half 17*b* from radially outwardly to radially inwardly during the compression phase to press the gas completely out of the lower working space 13*b*. As soon as the membrane 15 completely contacts the lower wall half 17*b*, the electromagnets 33 of the lower actuator unit 31*b* are deactivated again and a new activation of the electromagnets 33 of the upper actuator unit 31*a* begins.

The membrane 15 thus carries out a periodic deformation between the upper wall half 17*a* and the lower wall half 17*b* overall. The shape of the wall halves 17*a*, 17*b* allows a respective complete emptying of the respective working spaces 13*a*, 13*b* and is gentle on the material of the membrane 15. The frequency of the periodic deformation of the membrane 15 is controlled via the alternate activation of the electromagnets 33 of the upper or lower actuator units 31*a*, 31*b*.

The membrane vacuum pump 11 comprises two pump stages due to the upper and lower working spaces 13*a*, 13*b*. These two pump stages can either be connected in parallel in that the inlets 23*a*, 23*b* of both the upper wall half 17*a* and the lower wall half 17*b* are connected to the same recipient or are connected to a common main pump, for example to a turbomolecular pump. The outlets 25*a*, 25*b* are correspondingly connected to one another in such a parallel connection, i.e. they produce a common outlet line (not shown).

Alternatively, the two pump stages of the membrane vacuum pump 11 can also be connected in series, as is shown schematically in FIG. 2*c*. The outlet 25*a* in the upper wall half 17*a* is connected to the inlet 23*b* of the lower wall half 17*b* for this purpose. The path of the medium to be conveyed thus extends overall first via the inlet 23*a* of the upper wall half 17*a* into the upper working space 13*a*, subsequently via its outlet 25*a* and a line 43 (FIG. 2*c*) to the inlet 23*b* of the lower wall half 17*b*, via the inlet 23*b* into the lower working space 13*b* and via the latter to the outlet 25*b* in the lower wall half 17*b*. The part of the medium through the membrane vacuum pump is illustrated by the corresponding arrows 45 in FIG. 2*c*.

Since the electromagnets 33 of the actuator units 31*a*, 31*b* can each be controlled independently of one another, it is possible to specifically deform the membrane 15 such that the outlet 25*a* of the upper working space 13*a* remains closed by the membrane 15 for so long until the inlet 23*b* of the lower working space 13*b* is closed by the membrane 15. In other words, the membrane 15 is first only "attracted" by an activation of the electromagnets 33 of the lower actuator unit 31*b* in the marginal region 21 or in the sealing region 29 of the lower working space 13*b*, i.e. is deformed in the direction of the lower wall half 17*b*, while the membrane 15 is "held firm" in the central region, i.e. in the proximity of the axis 35, in the recess 19 of the upper wall half 17*a*. This state, in which the membrane 15 is deformed in a central region in the direction of the upper wall half 17*a* and simultaneously in a marginal region of the lower wall half 17*b*, is shown schematically in FIG. 2*c*.

In the directly subsequent suction phase of the upper working space 13*a*, no backflow from the lower working space 13*b* into the upper working space 13*a* takes place since the inlet 23*b* of the lower working space 13 is closed before the membrane 15 is released from the outlet 25*a* of the upper working space 13*a*. A check valve between the two pump stages, i.e. between the lower working space 13*b* and the upper working space 13*a*, can therefore be dispensed with on such a serial connection of the two pump stages of the membrane vacuum pump 11. The outlet 25*b* of the lower working space 13*b*, however, still has such a check valve to prevent the backflow.

Alternatively, the membrane 15 can be manufactured from or can comprise an electrorheological material. In this case, corresponding electrodes are used in the two actuator units 31*a*, 31*b* instead of the electromagnets 33.

The membrane vacuum pump 11, on the one hand, has the advantages of a conventional membrane vacuum pump, in particular with respect to a "dry" operation without lubricant such as oil which is required with piston pumps.

The operation of the pump 11 in accordance with the invention is additionally very quiet and low in vibrations.

The membrane vacuum pump is furthermore characterized by a particularly simple and compact construction with a relatively small number of parts and thus by comparatively small manufacturing costs.

In addition, with the membrane vacuum pump 11 in accordance with the invention, the disadvantageous "dead volume" of conventional membrane vacuum pumps, i.e. a volume in the working space which is not pumped out via an outlet, is avoided in that the membrane 15 completely contacts the upper or lower wall half 17*a*, 17*b* in the respective recess 19 at the end of the respective compression phase of the upper or lower working space 13*a*, 13*b*.

REFERENCE NUMERAL LIST

11 membrane vacuum pump
13*a* upper working space
13*b* lower working space
15 membrane
17*a* upper wall half
17*b* lower wall half
19 recess
21 marginal region
23*a*, 23*b* inlet
24 arrow
25*a*, 25*b* outlet
27 opening
29 sealing region
31*a* upper actuator unit
31*b* lower actuator unit
33 electromagnet, actuator
35 axis
41 control device
43 line
45 arrow

The invention claimed is:

1. A membrane vacuum pump,
comprising a first working space which is bounded by a membrane deformable to change the size of the first working space and by a wall in which wall at least one inlet and at least one outlet are formed for a medium which is sucked into the first working space in a suction phase via the inlet, with the first working space increasing in size in the suction phase and with the medium being expelled out of the first working space in a compression phase via the outlet, with the first working space decreasing in size in the compression phase; and
further comprising a controllable actuator unit for deforming the membrane by a contactless action on the membrane by means of electrical and/or magnetic fields,
wherein the pump comprises a second working space, and the membrane separates the first and second working spaces, respectively, which are bounded from one another by a wall,
wherein the outlet of the first working space is connected to the inlet of the second working space for forming two pump stages connected in series,
wherein each of the first and second working spaces provided with a recess formed in the wall, and the at least one outlet is arranged at a recess center, and
wherein the actuator unit is controllable such that the respective outlet of the first working space remains closed by means of the membrane until the inlet of the second working space is closed by means of the membrane.

2. The vacuum pump in accordance with claim 1,
wherein the pump has an axis along which the membrane is deformable and which is surrounded by an annular sealing region between the membrane and the wall.

3. The vacuum pump in accordance with claim 2,
wherein each of the first and second working spaces is rotationally symmetrical with respect to the axis.

4. The vacuum pump in accordance with claim 1,
wherein the membrane is deformable by means of the actuator unit into the recess in the compression phase and out of the recess in the suction phase.

5. The vacuum pump in accordance with claim 4,
wherein the recess is rotationally symmetrical with respect to the pump axis.

6. The vacuum pump in accordance with claim 1,
wherein the wall defines a curve which is continuously differentiable in every cross-section including the pump axis.

7. The vacuum pump in accordance with claim 1,
wherein the membrane is deformable from an outer marginal region inwardly in the direction of the pump axis.

8. The vacuum pump in accordance with claim 1,
wherein the actuator unit comprises a plurality of actuators.

9. The vacuum pump in accordance with 26,
wherein the plurality of actuators comprise electromagnets or electrodes acted on electrically.

10. The vacuum pump in accordance with claim 1,
wherein the membrane comprises a material or consists of a material which is magnetic and/or magnetizable or which is electrorheological or magnetorheological or dielectric.

11. The vacuum pump in accordance with claim 1,
wherein the actuator unit comprises a plurality of actuators arranged distributed at the wall outside the working space.

12. The vacuum pump in accordance with claim 11,
wherein the actuators are arranged concentrically about the space axis.

13. A membrane pump,
comprising at least one working space which is bounded by a membrane deformable to change the size of the working space and by a wall in which wall at least one inlet and at least one outlet are formed for a medium which is sucked into the working space in a suction phase via the inlet, with the working space increasing in size in the suction phase and with the medium being expelled out of the working space in a compression phase via the outlet, with the working space decreasing in size in the compression phase; and
further comprising a controllable actuator unit for deforming the membrane by a contactless action on the membrane by means of electrical and/or magnetic fields,
wherein the working space is provided with a recess formed in the wall, and the at least one outlet is arranged at a recess center, and
wherein the membrane has a variable thickness profile corresponding to shape of the recess formed in the wall.

14. A system, comprising at least two cooperating membrane vacuum pumps which are connected in series and/or in parallel and each having at least one working space which is bounded by a membrane deformable to change the size of the working space and by a wall in which wall at least one inlet and at least one outlet are formed for a medium which is sucked into the working space in a suction phase via the inlet, with the working space increasing in size in the suction phase and with the medium being expelled out of the working space in a compression phase via the outlet, with the working space decreasing in size in the compression phase; and
further comprising a controllable actuator unit for deforming the membrane by a contactless action on the membrane by means of electrical and/or magnetic fields, and
wherein the working space of each pump has a recess formed in the pump wall with the pump outlet being arranged in the recess center, and
wherein the membrane has a variable thickness profile corresponding to the shape of the recess formed in the wall.

15. The vacuum pump in accordance with claim 13,
wherein the working space has an axis along which the membrane is deformable and which is surrounded by an annular sealing region between the membrane and the wall.

16. The vacuum pump in accordance with claim 15,
wherein the working space is rotationally symmetrical with respect to the axis.

17. The vacuum pump in accordance with claim 13,
wherein the inlet can be closed by means of the membrane.

18. The vacuum pump in accordance with claim 13,
wherein the membrane is deformable by means of the actuator unit into the recess in the compression phase and out of the recess in the suction phase.

19. The vacuum pump in accordance with claim 18,
wherein the recess is rotationally symmetrical with respect to the axis of the working space.

20. The vacuum pump in accordance with claim 13,
wherein the wall defines a curve which is continuously differentiable in every cross-section including the axis of the working space.

21. The vacuum pump in accordance with claim 13,
wherein the actuator unit is controllable such that the membrane is deformable in a different manner over time and/or in location.

22. The vacuum pump in accordance with claim 13,
wherein the membrane is deformable from an outer marginal region inwardly in the direction of the axis of the working space.

23. The vacuum pump in accordance with claim 13,
wherein the actuator unit comprises a plurality of actuators.

24. The vacuum pump in accordance with claim 23,
wherein the plurality of actuators comprise electromagnets or electrodes acted on electrically.

25. The vacuum pump in accordance with claim 13,
wherein the membrane comprises a material or consists of a material which is magnetic and/or magnetizable or which is electrorheological or magnetorheological or dielectric.

26. The vacuum pump in accordance with claim 13,
wherein the actuator unit comprises a plurality of actuators arranged distributed at the wall outside the working space.

27. The vacuum pump in accordance with claim 26,
wherein the actuators are arranged concentrically about the axis.

* * * * *